United States Patent [10]

Gross

[11] 4,052,839

[45] Oct. 11, 1977

[54] COIN-PACKAGING MACHINE

[75] Inventor: Erwin Gross, Karlsruhe, Germany

[73] Assignee: Standardwerk Eugen Reis GmbH, Bruchsal, Germany

[21] Appl. No.: 709,099

[22] Filed: July 27, 1976

[30] Foreign Application Priority Data

Aug. 16, 1975 Germany ..... 2536427

[51] Int. Cl.[2] ..... B65B 11/04

[52] U.S. Cl. ..... 53/212

[58] Field of Search ..... 53/32, 212

[56] References Cited

U.S. PATENT DOCUMENTS

| | | | |
|---|---|---|---|
| 2,635,402 | 4/1953 | Jorgensen | 53/212 |
| 2,709,880 | 6/1955 | Jorgensen | 53/212 X |
| 2,855,739 | 10/1958 | Schoenewolf | 53/212 |
| 3,000,160 | 9/1961 | Speggiorin et al. | 53/212 |
| 3,432,983 | 3/1969 | Picollo | 53/212 X |

*Primary Examiner*—Travis S. McGehee

[57] ABSTRACT

A coin-packaging machine in which individual coins are stacked in a coin tube which tube and the coins are carried by means of a cam driven system from a stacking position, to a wrapping position where the coins are wrapped into a roll and from there to a discharge position where the finished coin roll is removed from the tube and from which position the empty stacking tube is subsequently returned to the initial stacking position. The stacking tube consists of a hollow cylinder open at both ends, the longitudinal wall of which is at least partially cut away for entering of the wrapper and for engagement there of an accelerating roller to effect wrapping.

14 Claims, 6 Drawing Figures

COIN-PACKAGING MACHINE

BACKGROUND OF THE INVENTION

The invention relates to a coin-packaging machine in which a predetermined number of coins are packaged by wrapping a stack of coins with a strip of paper to form a roll of coins.

In the generally known coin-packaging machines, coins are introduced in a specific predetermined number, into a stacking cylinder or tube which forms them into an orderly stack of coins. Thereafter, this stack of coins is removed and bodily transported to a wrapping device where the coin roll is formed, wrapping the stack of coins with a strip of paper, the ends of which are folded over to close the roll.

Although the known coin-packaging machines have been developed to a high degree of automation, a completely satisfactory state of operational reliability has not been reached. This is partly due to the complexity of each of the very large number of moving parts which must be accommodated in the limited space of the machine, and principally because of the complex and critical operating cycle, which require the transfer of the stack of coins from the stacking tube to the wrapping device. During such transfer, it repeatedly happens that the stack of coins collapses and the individual coins are scattered in the machine. This results in failure of the machine and in reduction of the serviceability of the entire packaging machine, frequently damaging its delicate parts.

A further reason for the fact that coin-packaging machines have not spread into all potential areas of use is their high cost.

It is the object of the present invention to produce a coin-packaging machine which would be as small, simple and economically manufactured as possible with a reduced number of moving parts and an increased operational reliability and in which the disadvantages of the known large machines are overcome.

The foregoing object and others as well as the numerous advantges of the present invention will be set forth in the following disclosure of the present invention.

SUMMARY OF THE INVENTION

According to the invention, a coin-packaging machine is provided with means by which the individual coins are stacked in a coin tube which tube and the coins are carried by means of a cam driven system from a stacking position, to a wrapping position where the coins are wrapped into a roll and from there to a discharge position where the finished coin roll is removed from the tube and from which position the empty stacking tube is subsequently returned to the initial stacking position. According to the invention, the stack of coins remain in the coin tube through the cycle from the stacking position to the discharge position.

This arrangement overcomes one of the main difficulties encountered up to now, namely the removal of the stack of coins from a stacking tube and its free transport to the wrappping position. The coins now remain in the stacking tube from the beginning to the end of the entire operation so that collapse of the stack of coins no longer occurs.

The stacking tube consists for this purpose of a hollow cylinder open at both ends, the longitudinal wall of which is at least partially cut away for engagement therein of an accelerating roller and in which wall two vertical guide rollers projecting slightly into the interior of the hollow cylinder are arranged in order to guide the coins into proper arrangement.

The gradation in cylinder diameter from tube to tube may amount to 1 mm. so that coins with diameters diverging by up to 0.9 mm. can be handled in the same tube. The coin tubes are also of the same length so that stacks from 10 to 120 mm. high can equally be handled in the tube corresponding to the diameter of the coins. A relatively small supply of coin tubes is therefore sufficient to produce rolls of the most common types of coins from all parts of the world.

Use can also be made of a simplified stacking tube consisting only of the hollow cylinder open at both ends, the wall of which is partially cut away for the point of contact of the accelerating roller but in which there are no longer any vertical guide rollers arranged but rather simply two longitudinally drilled holes into which can be inserted two vertical guide rollers which likewise project slightly into the interior of the hollow cylinder.

In this case, the two vertical guide rollers may be arranged on moving members of the packaging machine which can be swung by means of tong-shaped supports into the longitudinal holes of the stacking tube so that they guide the stack of coins as in the stacking tube fitted with guide rollers. Without guide rollers, the stacking tubes are cheaper to manufacture and even can be composed of plastic.

The tube is guided from the stacking position to the wrapping position, then to the discharge position for the finished coin roll and back to the stacking position by means of a longitudinal guidance system and a transverse guidance system. The longitudinal guidance system consists of a cam plate, a transmission arm and longitudinal feed bars on which a sliding coin tube holder with the coin tube is mounted. The transverse guidance system consists of a cam plate, a control member and a sliding guide block above which is located a fixed support plate on which the coin tube is conveyed to its various positions. For this purpose, the longitudinal feed bars are mounted on the guide block so that the coin tube holder and the coin tube also participate in the transverse movements of the guide block.

As a result of the series arrangement of the individual operations of stacking, wrapping and discharge, and by indexing and conveying the stack of coins to these operational stages in one tube, the entire packaging machine can be simply and cheaply constructed.

Concentrically arranged under the stacking tube in the stacking position may be an electric vibrator which passes through the support plate and which acts on the coins when they are being stacked, so as to further ensure that the coins falling into the tube always from an orderly stack and blockages are prevented.

In the wrapping position, a lifting rod is provided, passing through the support plate to lift the stack of coins in the coin tube to space the stack within the wrapper and form the projecting paper edges for the closing process. The rod is subsequently lowered by means of a cam member, through the support plate into the guide block. As a result, the stack of coins can remain in the tube even during wrapping because the lifting of the stack of coins creates space for the formation of a projecting paper edge for the folding or closing process.

In the wrapping position, there is arranged a fixed accelerating roller which, operating in the cut away area of the tube, sets the stacks of coins in rotation while the wrapping paper is introduced by the paper feed rollers. This eases the wrapping processes by moving the coins in the direction of paper movement. Two folding hooks, controlled by cams and running on guide bars, are provided for folding the projecting paper edge.

In front of the paper feed rollers, a fixed paper guide roller is provided which holds the advancing wrapping paper taut. The length of wrapper paper to be delivered to the coin tube is determined by selecting a particular number of revolutions of one of the two paper feed rollers for which purpose its driving shaft may be fitted with control discs provided with switches which start and stop the driving mechanism via a revolution counter. When the predetermined length of wrapping paper is unwound, the revolution counter activates an electromagnet which brings a paper cutter into the path of the paper, the paper driving mechanism being simultaneously switched off. Thus, as a simplification, only two or three different lengths, of paper are used for all coins to be packaged.

In the case of a paper feed roller with a diameter of, for example, 20 mm., two revolutions afford a length of paper of about 125 mm. and three revolutions a length of about 188 mm. The revolution counter is therefore set to only two or three revolutions according to the size of the coins. It is then sufficient to use a paper length of 125 mm. for coins up to 20 mm. in diameter and a paper length of 188 mm. for all larger coins.

It will then be seen that the particular advantages of the coin-packaging machine according to the present invention are principally its simple construction, its small dimensions, its relatively small weight, ease of operation and maintenance and above all its low manufacturing cost and its high degree of operational reliability because of the elimination of feared collapses of the coin stacks during tansfer by the continuous handling of the coins in one tube.

Full details of the present invention are set forth in the following description and in the accompanying drawings of the preferred embodiments.

DESCRIPTION OF THE INVENTION

Figure 1:
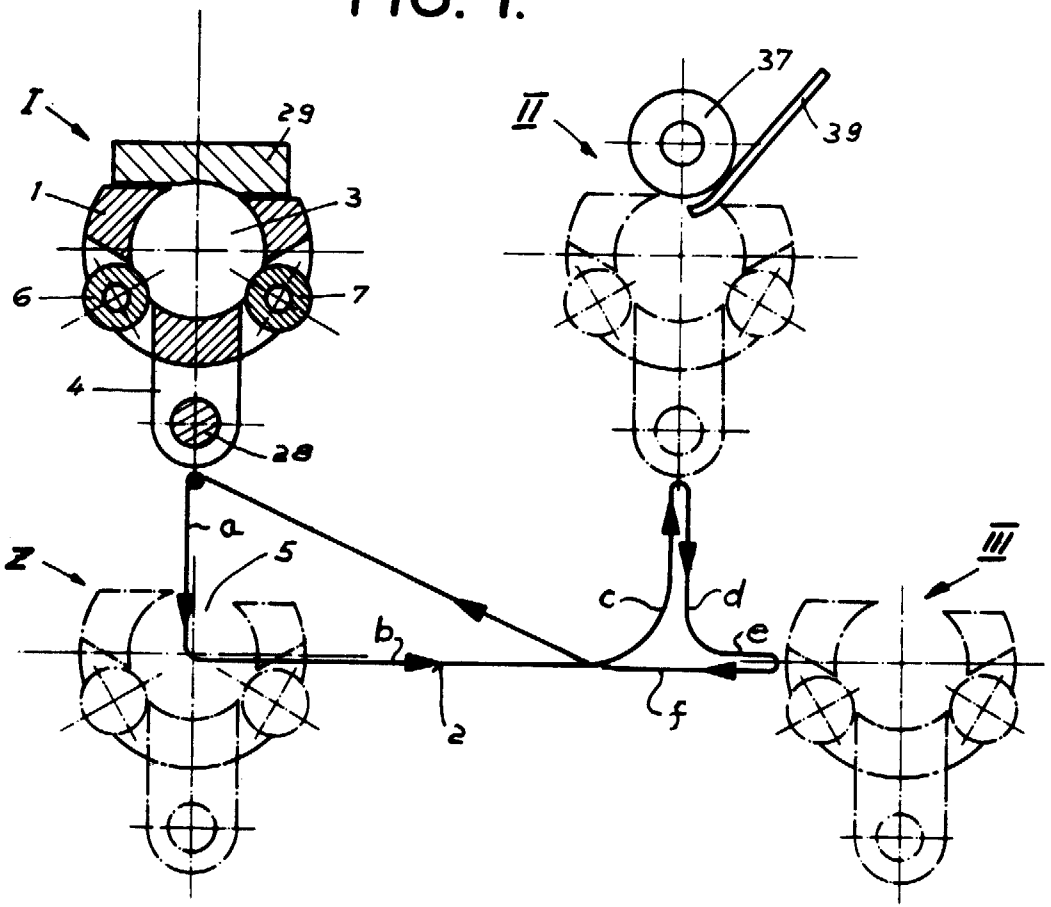
FIG. 1 is a diagram of the operating plan of the tube with the various positions into which it is indexed in the course of a work cycle.

As seen in FIG. 1, the entire operating cycle is completed in one continuous movement in which the coin tube 1 is guided by means of a longitudinal and a transverse movement from a stacking position I, wherein coins are delivered and stacked in the tube, via an intermediate postion Z, into a wrapping position II, wherein the stack is wrapped, from there into a discharge position III where the finished coin roll is discharged. From there, the tube moves back to the stacking position I. In FIG. 1, the direction of motion is indicated by the arrow 2. The coin stack formed in tube 1 in the stacking position I remains, always, in this coin tube until the discharge position III.

Figure 2:
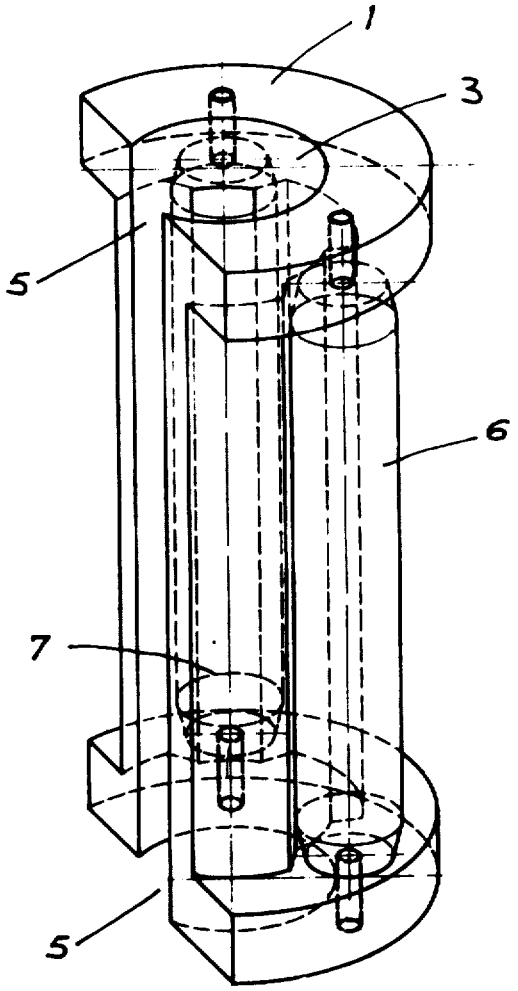
FIG. 2 is a perspective view of a coin tube without its attachable part.

As seen in FIG. 2, the coin tube 1 consists of a hollow cylinder 3 which is open at both ends and which is provided with a radially outward extending lip or flange at each end, and a radially inward flange at the lower end to support a stack of coins. The cylinder is provided with an integral arm 4 (FIG. 1) extending from its rear wall. Opposite the arm 4, the cylinder wall is at least partially provided with a longitudinal cut-away slot 5. Located in suitable recesses within the wall, there are two freely rotating vertical guide rollers 6, 7 which project slightly into the interior of the hollow cylinder 3 so as to be in contact with the coins. The rollers 6, 7 are journalled at their ends in the flanges and are capable of being rotated so that the coin stack located in the tube may be later set in rotation.

Figure 3:
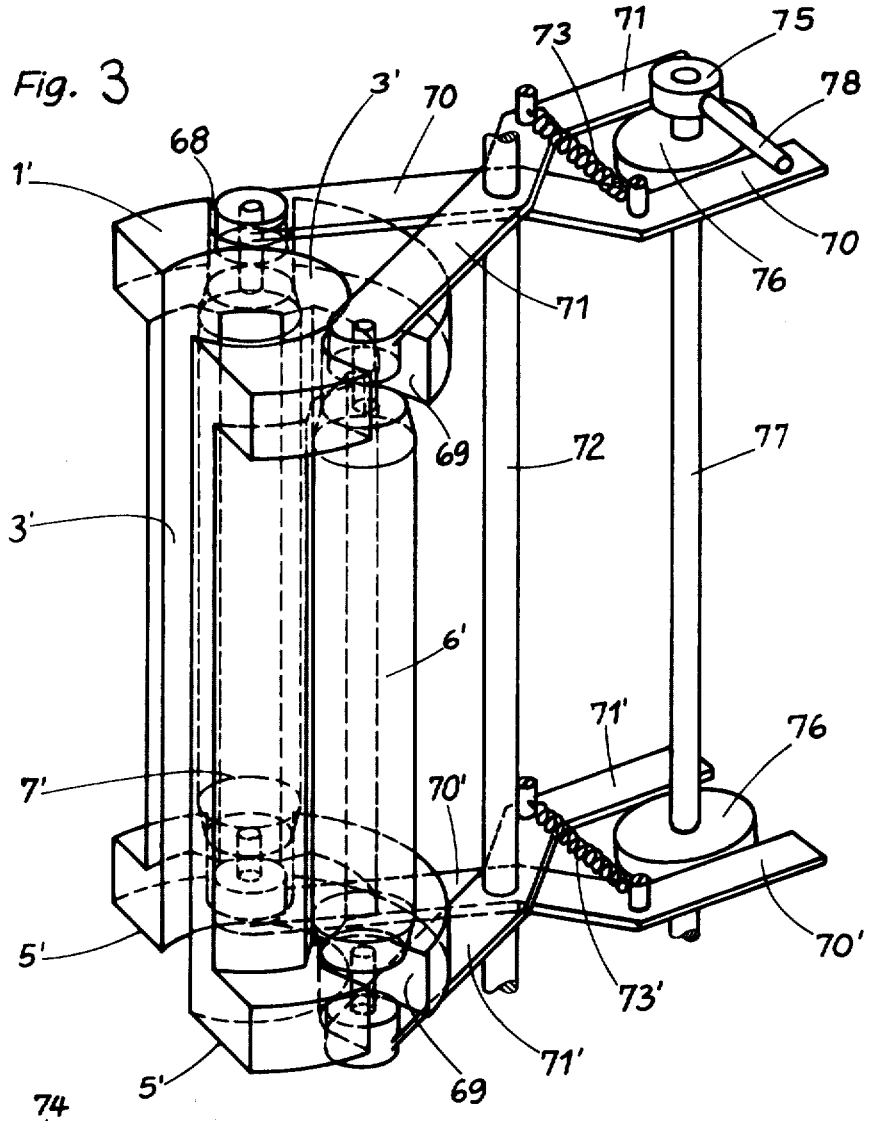
FIG. 3 is a view of modified tube similar to FIG. 2.
Figure 4:
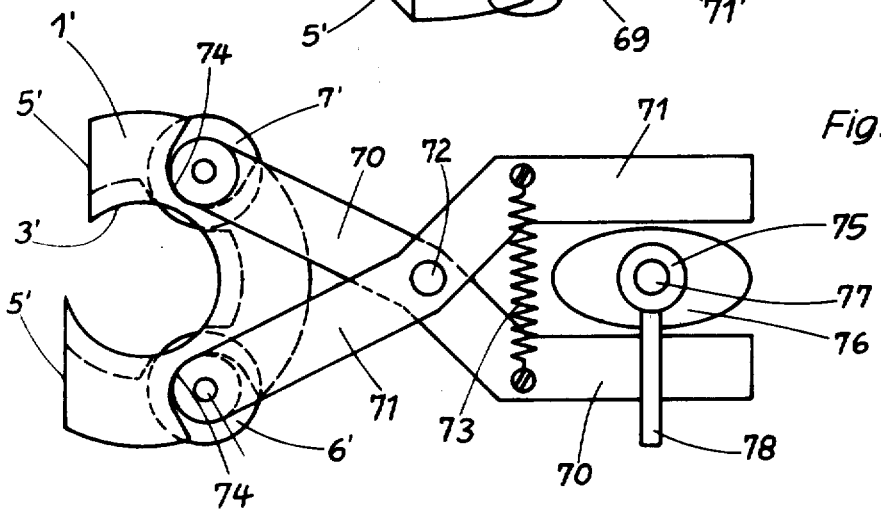
FIG. 4 is a plan view of the tube shown in FIG. 3.

In the embodiment of FIGS. 3 and 4, a simplified tube 1' is depicted consisting in this case only of a hollow cylinder 3' open at both ends with a larger cut away slot 5' and, uniformly spaced therefrom on opposite sides, two smaller cut away parts 68, 69 to accommodate the guide rollers 6', 7' which again project slightly into the interior of the hollow cylinder 3'. In this embodiment, however, the guide rollers 6', 7' are thus not journalled directly in the coin tube 1' but rather are mounted and journalled at the ends of a tong-shaped arm 70, 71 and 70', 71' held together by a shaft 72 which is mounted in the surrounding machine parts exterior of the tube 1. The tongs serve not only to hold the rollers but also to support and guide the cylinder in the operating cycle. A tension spring 73 fixed at each end to the upper tong arms 70, 71 and a tension spring 73' fixed similarly to the lower tong arms 70', 71' ensure closure of the guide rollers 6', 7' so that they engage the seats 74, aligned with cut away parts 68, 69, provided as notches at the upper and lower flanges of the tube 1'. By this means, the coin tube 1' is held in position and the guide rollers 6', 7' project slightly into the interior of the hollow cylinder 3' and guide the coin stack to be located there.

By this arrangement, that is with guide rollers arranged separately from the tube and mounted to the surrounding machine parts, the tubes can be manufactured more simply and economically.

In order to select coin tubes 1' with different diameters, appropriate to fairly large or fairly small coins, a knob 75 is arranged on a connecting shaft 77 with a cam plate 76 located between the rear arms of the upper tong arms 70, 71 and of the lower tong arms 70', 71', respectively. On rotating the knob 75 by means of the control lever 78, the cam plates 76 force the fore parts of the upper tong arms 70, 71 and of the lower tong arms 70', 71' apart and hence the guide rollers 6', 7' may be selectively retracted radially from the coin tube 1'. Another coin tube can now be inserted in the machine, enabling replacement of tubes for different size coins. On turning the cam plates 76 back, the guide rollers 6', 7' again fit into the cut away parts 68, 69 and the new coin tube is guided and gripped in the machine during the execution of the successive stages in the work cycle.

Figure 5:
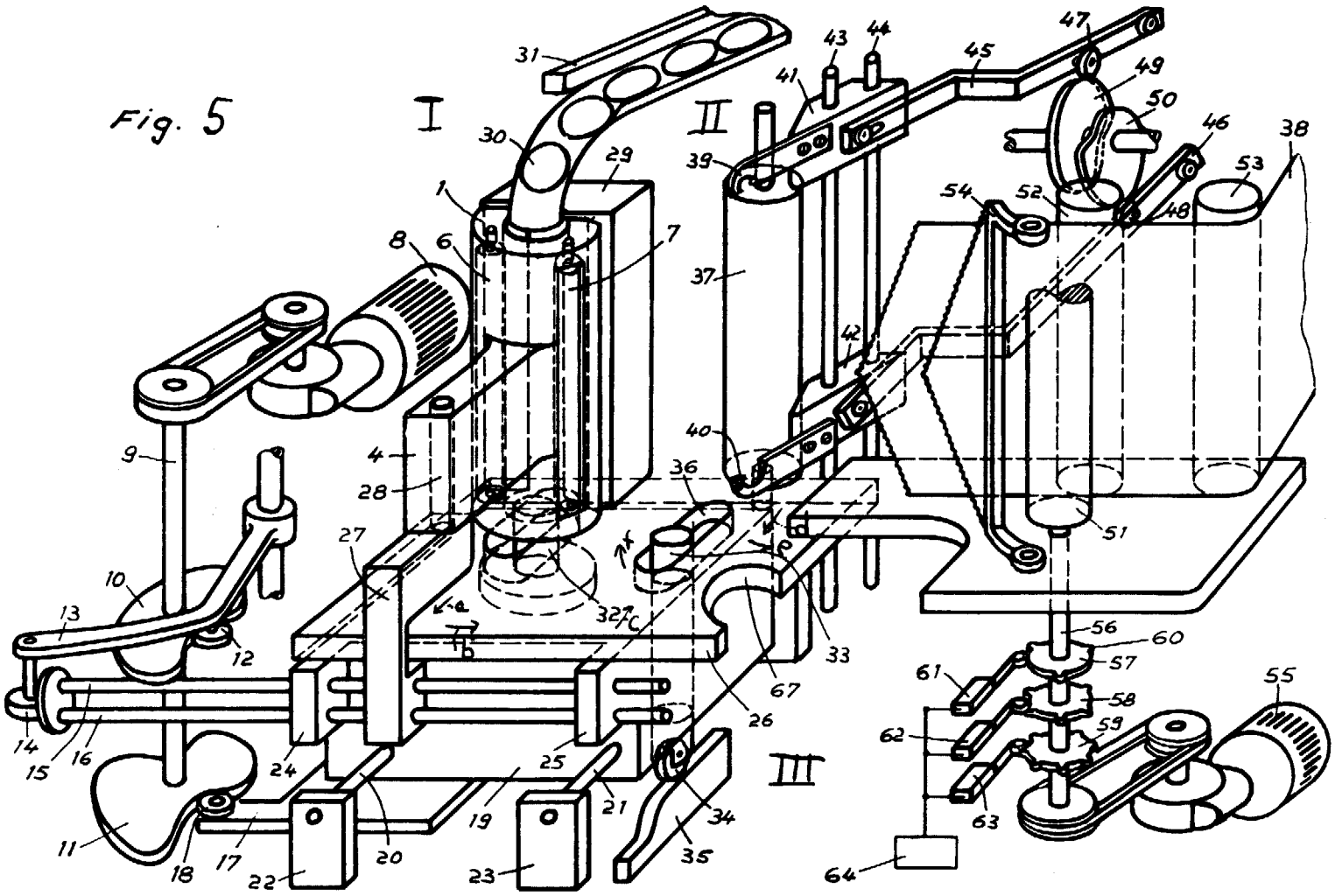
FIG. 5 is an overall view of the coin-packaging machine.

As seen in FIG. 5, the main driving mechanism of the machine is the driving motor 8 which drives a main driving shaft 9. Cam plates 10 and 11 are fixed on the main driving shaft 9. A follower roller 12 engages the edge of the cam plate 10 and controls the movement of a transmission arm 13 which, in turn, by way of a roller 14, controls the movement of a pair of parallel feed bars 15, 16, which cause the longitudinal feed movement of the tube.

A second control arm 17 provided with a follower roller 18, which engages the second cam plate 11, moves guide block 19 to produce the transverse motion. The guide block 19 runs on transverse guide bars 20, 21 which are mounted in supports 22, 23.

The feed bars 15, 16 of the longitudinal feed are mounted in the supports 24, 25, which extend from the read of the guide block. The feed bars 15, 16 carry a holder 27 provided with a pin 28 on which is journalled the rearwardly extending arm 4 of the stacking tube 1. Above the transversely movable guide block 19 is located a fixed supporting guide table 26, on which the bottom end of the tube 1 rests in slidable contact. The holder 27 thus moves similarly to the movement of a machine tool, tool holder, (i.e., lathe, planer or grinder), in a longitudinal and transverse direction above the supporting table.

When using the simplified coin tube 1' according to FIGS. 3 and 4, the shaft 72 of the previously described arrangement of tong-shaped arms 70, 71 and 70', 71' is journalled on the holder 27 and the retractable guide rollers 6', 7' hold the stacking tube 1' and move it into its various positions. The arm 4 is thus not employed, but otherwise, the apparatus is the same.

In the situation shown in FIG. 5, the tube 1 is in the stacking position I (FIG. 1). A block-like member 29 is mounted on the machine frame and is located so that when the tube is in position I, it closes the slot 5 so that a closed stacking space is formed for the receipt of coins. Coins 30 are delivered from a feed 31 of known construction from a conventional coin counting machine which is not illustrated. Located concentrically below coin tube 1 is an electric vibrator 32 which passes through the supporting guide table 26 into contact with the lowermost coin.

Also passing through the support guide table 26 and the guide block 19 is a lifting rod 33, the height of which is controlled by a roller 34 resting on the upper edge of a cam plate 35, mounted so as to be conjointly movable transversely with the guide block 19. The rod extends through a slot 36 in the crosshead guide table 26 and is aligned with an accelerating roller 37 located at the wrapping station II. The accelerating roller 37 is elongated and adapted to enter into the slot 5 of the tube 1 so as to engage the coins stacked therein. The accelerating roller is mounted on shaft suitably journalled along a vertical axis which shaft is connected by suitable belt or gear transmission to a drive motor so that it can be rotated at high speed.

When the coins are ready for wrapping, that is for producing the coin rolls, the tube 1 is moved by action of the longitudinal and transverse feeds so that it is brought, with its cut away slot 5, against the accelerating roller 37 (FIG. 4) directly above the lifting rod 33. With the assistance of the guide rollers 6, 7 and the lifting rod 33 which raises the stack, the accelerating roller sets the coins into rapid rotation. The wrapping paper 38 which is supplied into the slot 5 is drawn by this rotary motion into the tube 1 where it wraps the coin stack.

The folding device for rolling the edge of the paper which now comes into operation consists of folding hooks 39, 40 which enter the slot 5, folding hook supports 41, 42 mounted on vertical guide bars 43, 44 and control arms 45, 46 which are moved via rollers 47, 48 engaging cams 49, 50. As the cams 49, 50 rotate by suitable connection to the drive means, the folding hooks 39, 40 fold over the wrapping paper 38 projecting above and below the coin stack to form a rolled edge and then return to their open position. As will be seen in FIGS. 1, 2 and 3, the wall of the tube, adjacent the slot 5, is cut away chordally but not coplanarly so as to provide longitudinal flat surfaces for abutment with corresponding surface of the closing member 29. The right surface, as seen in the drawings, is, however, cut further away from that of the left-hand surface so that when the tube 1 is positioned adjacent the accelerating roller 37, a small gap is provided which permits the paper 55 and the hooks 39, 40 to enter through the slot for engagement with the coins and the paper respectively.

The system for delivering the wrapping paper 38 consists of a paper feed roller 51, a counter-roller 52, a guide roller 53 located at the paper entry point and a paper cutter 54. The paper comes to the guide roller 53 from a suitable source such as a substantially endless reel or spool.

A motor 55 drives the paper feed roller 51 via its shaft 56 and the counter-roller 52 runs freely with it while the guide roller 53 remains fixed and consequently holds the incoming wrapping paper 38 taut. It may be spring biased, if desired.

Figure 6:
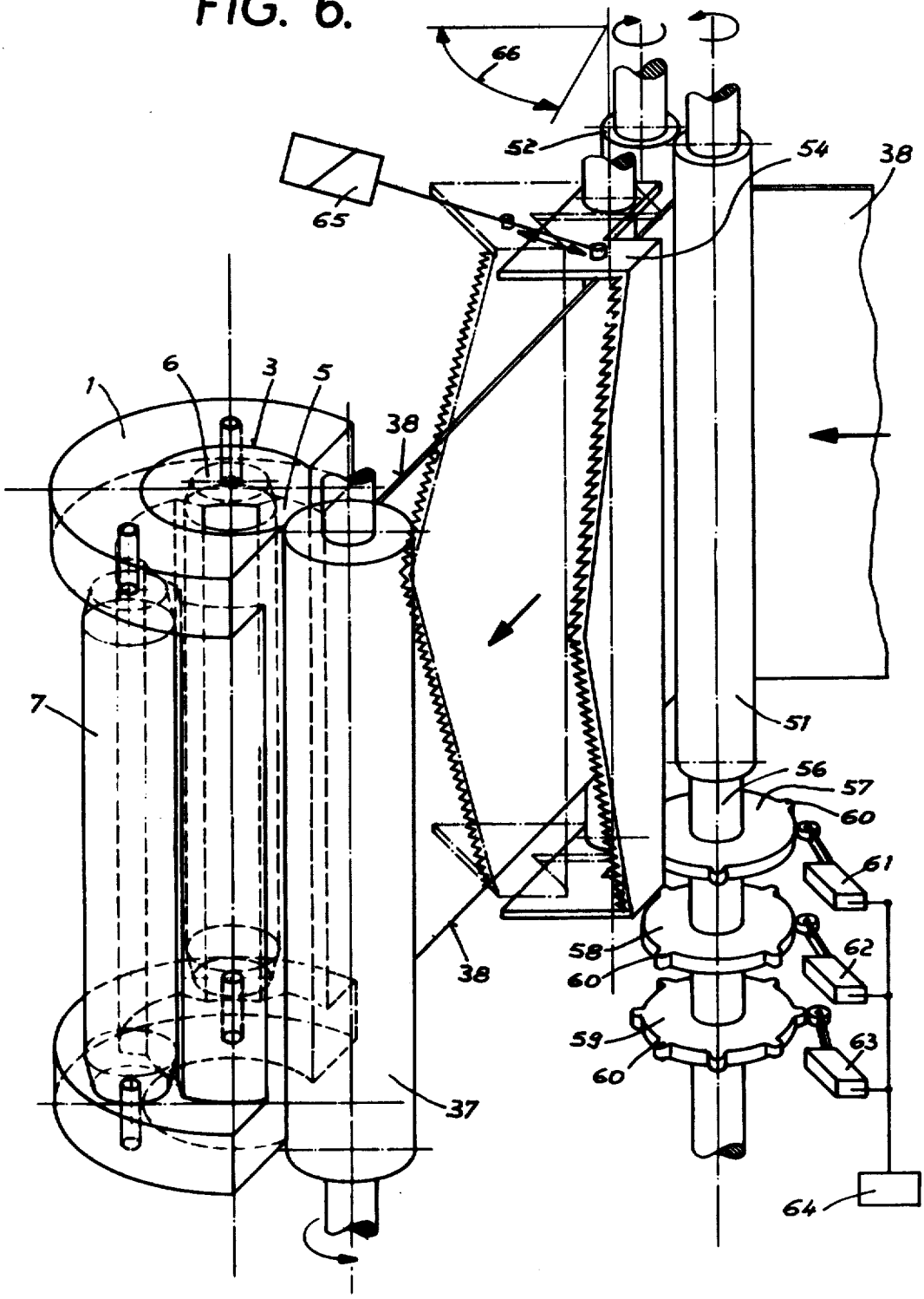
FIG. 6 is a detail view of the wrapping station with the tube in the wrapping position.

As seen in FIG. 6, there are mounted on the shaft 56 indexing cams 57, 58, 59, each having radial cam pins 60 which trip switches 61, 62, 63 and hence act in the revolution counter 64. The revolution counter 64 counts a constant 12 contacts and then switches the motor 55 off. Each of the cams 57, 58 and 59 have a different number of cam pins and each of the cam switches 61, 62 or 63 may be separately actuated so that the constant 12 count of the counter 64 can be made to depend from a different number of rotations of the shaft 56 and thus determine a different length of paper fed to the coin stack. Thus, if cam 57, which has three cam pins, is used, the paper feed roller would complete four revolutions and deliver a corresponding length of wrapping paper 38 before the switch tripping cycle is completed. Switching the motor 55 off results in simultaneous actuation of a pre-biased solenoid 65 to which the paper cutter 54 is connected. The solenoid causes the bar type paper cutter to move through an angle 66 into the path of the paper, cutting off the predetermined length, whereupon the end folding is accomplished by the aforedescribed mechanism.

Thereafter, the tube 1 is indexed further over the table 26 where the finished coin roll is discharged from the tube through outlet 67, cut in the table. Once the tube 1 is free, the tube is carried back to the stacking position I.

The control of the entire operation of the machine may be obtained by means of a conventional arrangement of microswitches and relays in a manner known to those skilled in this art.

The number of coins required to form the coin stack in the tube is determined by the coin counting machine which issues a start signal to the driving motor 8.

The accelerating roller 37 and the vibrator 32 are arranged to run continuously when the machine is switched on. As soon as the coin tube 1 comes into contact with the accelerating roller 37, the motor 55 for the paper feed roller 51 may be switched on by actuation of a microswitch associated with the roller 37 which senses the presence of the tube in the proper position, and remains in operation until the revolution counter 64 switches the motor 55 off again and the paper cutter is actuated.

Withdrawal of the paper cutter 54 sets the folding hooks 39, 40 in motion, which enter into the slot 5, move opposite each other to fold the edges of the paper. On completion of the folding process, the hooks 39, 40 are withdrawn and re-start the driving motor 8 which then conveys the coin tube to the discharge position III and back to the stacking position.

The structure described and the control mechanisms are arranged so that the coin packaging machine will function as follows. A predetermined number of coins 30 from a coin-counting machine of known construction is stacked via the feed 31 in the coin tube 1 which is located in the stacking position I with its cut away slot 5 adjacent to the closing member 29. The driving motor 8 is initially switched off. The vibrator 32 ensures that a closed column of coins is formed in the coin tube 1.

Subsequently on the sensing of the delivery and/or stacking of a given number of coins, the driving motor 8 is started and the driving shaft 9 with cam plates 10, 11 is set in motion. The cam plate 11, via the roller 18, now moves the control member 17, and with it, the guide block 19 of the transverse guidance system, forward. The coin tube 1 is moved with its bottom edge in contact with the surface of the table 26, so the coins are not dislodged, into the intermediate position Z (FIG. 1) that is linearly away from the closing member 29 as seen by the arrow *a*. The cam plate 10, now comes into operation via the roller 12 and the transmission lever 13 pushes the longitudinal feed bars 15, 16 with the tube holder 27 and the coin tube 1 to the right as seen by arrow *b*. The cam plate 11 then moves the guide block 19 to the rear again as seen by arrow *c* so that the tube 1 is conveyed into the wrapping position III.

On the way to the wrapping position II, the tube passes over the lifting rod 33, which is raised by the curved cam 35, lifting the coin stack in the coin tube 1 so that it is spaced from the table 26, allowing the paper to be fed around the stack and forming a projecting edge for the wrapping process.

At the cut away part 5 of the coin tube 1, the column of coins is now adjacent to the accelerating roller 37, the rotary motion of which cooperating with the guide rollers 6, 7 sets the column of coins in rapid rotation. Simultaneously, the driving mechanism 55 of the paper feed roller 51 starts and by means of its revolution counter 64, a predetermined length of wrapper paper 38, which envelops the coin stack in the coin tube 1, is introduced between the accelerating roller 37 and the guide rollers 6, 7. On reaching the preselected length of paper, determined by choice of the switch 61, 62 or 63, the paper cutter 54, actuated by the solenoid 65, moves into the path of the paper and separates the wrapping length from the arrested paper supply.

The folding hooks 39, 40 are then set in motion by the cams 49, 50 and the column of coins, which is kept rotating in the coin tube 1, is sealed by one hook at each end. The coin roll is thus complete and the folding hooks 39, 40 controlled by the cams 49, 50 move away along the guide bars 43, 44.

The driving motor 8 is now re-started and the cam plate 11 moves the transversely moving guide block 19 forward, arrow *d*, the lifting rod 33 runs down to the flat part of the curved cam 35 and sinks into the guide block 19 and the longitudinal feed bars 15, 16 are moved, conveying the coin tube 1 with the finished coin roll, arrow *e*, the outlet 67, discharge position III, where the finished coin roll drops from tube 1, into a chute or waiting receptacle.

The further movement of the cam plates 10, 11 carries via arrow *f* the coin tube holder 27 and with it, the coin tube 1 by joint movement of the longitudinal feed bars 15, 16 and of the transversely movable guide block 19 back into the stacking position I where a new operating cycle begins.

It will thus be seen that a simple apparatus is provided for wrapping coins based among other things on the use of a tube which retains the coins throughout the operating cycle, and into which the wrapper is inserted. It is possible, within the purview of the invention, to maintain the tube stationary, moving the closing member 29 and the accelerating roller and the paper feed into a position in front of the slot 5. The accelerating roller may even be located in the closing member, and re relatively movable therewith so as to obtain the sequential operation without movement of the tube.

Since various modifications, changes and embodiments have been described and suggested, it is intended that this disclosure be taken as illustrative only of the invention and not as limiting of its scope.

What is claimed is:

1. Apparatus for packaging a stack of coins into a roll comprising a flat supporting plate, a hollow cylindrical tube member open at both ends movably mounted above said plate, one end of said tube being in slidable contact with said plate, said tube extending perpendicularly therefrom for receiving coins in said other end, said coins being supported in stacked condition on said plate, a first station having means for feeding a predetermined number of coins to said tube, a second station having means for feeding a wrapper and wrapping said coins, and a third station having means for discharging said wrapped coins, said stations being disposedly spaced from each other about the plate and means for conveying said tube and the coins therein in slidable contact with said plate sequentially from said first to second to third positions and thereafter said tube free of coins from said third to first position.

2. The apparatus according to claim 1, including means for automatically feeding a group of coins to said tube when located at said feed station.

3. The apparatus according to claim 2, wherein the wall of said tube is partially cut away to form a longitudinal recess provided with freely rotating vertical guide rollers projecting slightly through said recess into the interior thereof in contact with said coins to rotate said coins in forming said stack.

4. The apparatus according to claim 3, wherein said cylinder is provided with a pair of recesses and guide rollers, said guide rollers being journalled on an arm pivotally mounted on a holder secured to said conveying means and provided with means for swinging said rollers into and out of said recesses.

5. The apparatus according to claim 4, wherein the guide rollers are mounted on tong-shaped arms which are held together by a shaft and each spanned by a tension spring so that the guide rollers engage seats provided on the upper and lower edges of the tube.

6. The apparatus according to claim 5, wherein a connecting shaft is provided between the hind parts of the upper ton garms and of the lower tong arms, respectively, a cam plate arranged on said shaft which can be turned by means of a knob and a control lever to open and to close the fore parts of the upper and of the lower tong arms whereby the guide rollers can be retracted from said coin tube.

7. The apparatus according to claim 3, wherein, at the stacking station, there is concentrically arranged under the coin tube an electric vibrator which passes through the supporting plate and which acts on the coins within said tube when they are being stacked.

8. The apparatus according to claim 3, wherein the means for movably supporting said tube in vertical position comprises a holding arm extending outwardly from the wall of said tube, said arm being connected to said conveying means.

9. The apparatus according to claim 8, wherein said means for conveying said tube conveyor comprises a longitudinal guidance system and a transverse guidance system, the longitudinal guidance system comprising a cam plate, a transmission arm and longitudinal feed bars on which said holding arm is mounted and the transverse guidance system comprises a cam plate, a control member and a sliding guide block above which is located said supporting plate, said longitudinal feed bars being mounted on the guide block so that the holding arm participates in the transverse movements of the guide block.

10. The apparatus according to claim 1, wherein, at the wrapping station, a lifting rod passing through the supporting plate is arranged which lifts the stack of coins in the coin tube, permitting the edge of the wrapping paper to project over the bottom of said stack for the wrapping process, and is subsequently lowered by means of a cam member through the supporting plate into the guide block.

11. The apparatus according to claim 10, wherein said tube is provided with a longitudinal slot, and in the wrapping position, there is arranged an accelerating roller which enters said slot to set the stack of coins in rotation while the wrapping paper is introduced into said slot by paper feed rollers, and a pair of folding hooks are provided for folding the projecting paper edge.

12. The apparatus according to claim 1, wherein the wrapping paper is fed from a roller and a fixed paper guide roller is provided which holds the supplied wrapping paper taut.

13. The apparatus according to claim 12, wherein the length of wrapping paper to be delivered to the coin tube is determined by selecting a particular number of revolutions of said paper feed roller, said feed roller being provided with a driving shaft having a cam provided with switch means for the start and stop of the driving mechanism via a revolution counter.

14. The apparatus according to claim 13, wherein, when the predetermined length of wrapping paper is unwound, the revolution counter actuates an electromagnet which directs a paper cutter into the path of the paper, the paper driving mechanism being simultaneously switched off.

* * * * *